US005842355A

United States Patent [19]

Kalis et al.

[11] Patent Number: 5,842,355

[45] Date of Patent: Dec. 1, 1998

[54] DEFROST CONTROL SYSTEM FOR A REFRIGERATOR

[75] Inventors: Jeffrey J. Kalis; Yury M. Langer, both of Rockwall, Tex.; Dick C. Bennett, deceased, late of Duncanville, Tex., by Jerri Bennett, executrix

[73] Assignee: Rowe International, Inc., Rockwall, Tex.

[21] Appl. No.: 409,674

[22] Filed: Mar. 22, 1995

[51] Int. Cl.[6] ..... F25B 47/02

[52] U.S. Cl. ..... 62/234; 62/156; 62/155; 62/182; 62/127

[58] Field of Search ..... 62/234, 155, 152, 62/156, 186, 229, 180, 182, 151, 154, 158, 127

[56] References Cited

U.S. PATENT DOCUMENTS

| | | | |
|---|---|---|---|
| 2,492,970 | 1/1950 | Curry | 62/182 X |
| 3,514,966 | 6/1970 | Kusuda | 62/156 |
| 3,890,798 | 6/1975 | Fujimoto et al. | 62/155 |
| 3,924,416 | 12/1975 | Durdin | 62/80 |
| 3,998,068 | 12/1976 | Chirnside | 62/186 |
| 4,084,388 | 4/1978 | Nelson | 62/152 |
| 4,151,723 | 5/1979 | Gardner | 62/156 X |
| 4,173,871 | 11/1979 | Brooks | 62/80 |
| 4,297,851 | 11/1981 | Paddock et al. | 62/126 |
| 4,299,095 | 11/1981 | Cassarino | 62/155 |
| 4,530,217 | 7/1985 | Alluto et al. | 62/156 |
| 4,750,332 | 6/1988 | Jenski et al. | 62/80 |
| 5,038,575 | 8/1991 | Yamada | 62/234 |
| 5,231,844 | 8/1993 | Park | 62/80 |

*Primary Examiner*—Harry B. Tanner
*Attorney, Agent, or Firm*—Locke Purnell; Rain Harrell

[57] ABSTRACT

A refrigeration controller is provided which thermostatically controls a refrigerated compartment temperature. A heated evaporator is provided within a certain wattage range to accelerate defrosting. The controller maintains the compartment temperature within a certain operating range; if the compartment temperature rises above a certain preselected maximum temperature, the controller activates the compressor and a blower to circulate air over the evaporator to reduce the temperature of the compartment. The controller provides a defrost loop which is periodically activated which controls the compressor, evaporator and heater cycle during defrost. If, during defrost, the evaporator reaches a maximum temperature, or if the food compartment temperature rises above a certain maximum, the heater is deactivated. An evaporator precool loop is provided which activates the compressor without activating the blower, thereby cooling the evaporator before hot air is allowed to circulate in the compartment. The controller is also physically separated from the main circuit board and mounted on a removable modular refrigeration unit, thereby isolating the controller from the main circuit board and protecting it. The invention also provides for reprogramming of the temperature ranges and command defrost and cooling cycles by a remote main circuit board.

20 Claims, 4 Drawing Sheets

29
TO RELAYS
K1 COMPRESSOR 44
K2 EVAPORATOR 46
K3 HEATER 48
TEMP 1 PROBE (FOOD)
TEMP 2 PROBE (EVAPORATOR)
+12V
+5V
VCC 2Y 1Y GND
2A 2B 1A 1B
VDD OSC1 OSC2 PD7 PB5 PD5 PC0 PC1 PC2 PC3 PC4 PC5 PC6 PC7
/RS /IRQ PA7 PA6 PA5 PA4 PA3 PA2 PA1 PA0 PB7 PB6 TCMP GND
R RE DE D
B A
VAD
S1 S2 S3 S4 S5 S6 S7 S8
R1 R2 R3 R4 R5 R6 R7 R8 R9 R10
R11 R12 R13 R14 R15 R16 R17 R18 R24 R25 R26 R27
C2 C3 C4 C6 C7 C8 C9 C10 C13 C14 C15
D5 D6 D7 D8 D10 D11 D12
CR1
Y1
32 34 36 38 40 42 50 52 54

DEFROST CONTROL SYSTEM FOR A REFRIGERATOR

BACKGROUND OF THE INVENTION

This invention pertains to the art of electronic control systems for refrigerators. More specifically, this invention relates to electronic defrost control systems for vending machines having a refrigerated compartment and a modular refrigeration unit. Defrost control systems are necessary because frost accumulates on the evaporator of refrigeration units, reducing their efficiency and ability to cool the food contained in the refrigerator. If the interior temperature of the refrigerator compartment is not monitored and controlled closely, the food contained can freeze or spoil from an improper temperature. Additionally, since some food items may be stored in vending machines for a long period of time, it is necessary to reduce temperature variation to a minimum. These problems are especially critical in vending machine applications where consistent and dependable automated performance is a necessity. The prior art contains many attempts at a solution to the problems associated with defrosting refrigerators; however, as will be seen below, none is completely satisfactory.

It is well known in the art to use mechanical timers to control defrost cycles. U.S. Pat. No. 3,924,416 to Durden discloses such a timer. Durden discloses a complex electromechanical device for switching on a defrosting heater after a certain period, and turning off the defrosting heater when the interior temperature of the compartment reaches a certain level. To implement this system, Durden discloses a device which consists of a series of mechanical switches coupled to a system of ratchets and pawls driven by motors. The switches control the defrost cycle. Durden does not disclose an electrical control system based on comparing stored temperature values. Nor does it disclose monitoring the evaporator temperature during defrosting or interrupting the defrost cycle when the temperature reaches an unacceptable level. Moreover, Durden does not disclose pre-cooling the evaporator after the heated defrost cycle, before the refrigeration cycle begins. Where food temperatures are critical, this can cause food spoilage, or at least severe deterioration in quality.

U.S. Pat. No. 3,514,966 to Kusuda, is representative of a body of prior art disclosing analog delay circuits used to control defrosting. Kusuda discloses a delay circuit which includes a pair of transistors arranged so that the base voltage of one is controlled by a thermistor exposed to the inside of a freezer cabinet. Initiation of the delay is controlled by a trigger input from a clock or other triggering event. Kusuda makes no provision for monitoring the temperature of the evaporator or the refrigeration during defrosting. Additionally, Kusuda makes no provision for resetting the temperature range at which defrosting takes place. This makes applying the invention in modular construction difficult and impractical.

U.S. Pat. No. 5,038,575 to Yamada discloses a device which automatically deactivates a defrosting device in response to the overheating of the evaporator if it exceeds a preset time. There is no provision made for monitoring the refrigerator temperature while the defrost cycle is active, nor is there provision for forcibly interrupting the defrost cycle when the temperature in the refrigerator becomes too high. Additionally, Yamada makes no provision for changing the temperature range which activates the compressor or the defrost cycles during operation of the refrigerator.

U.S. Pat. No. 4,750,332 to Jensky, discloses a refrigeration control system with a self-adjusting defrost interval. The length of time it takes to heat the evaporator to a certain fixed defrost temperature is logged. The log is incorporated into a register which is used to alter the compressor cycle time. If the time period increases from the prior cycle, then the time between the defrost cycles is reduced; if the time decreases, then the time between defrost cycles is increased.

Jensky fails to monitor the compartment temperature during the heating cycles of the evaporator. If the defrost cycle takes too long, the compartment temperature may exceed the limit required for safe food storage and, therefore, the stored food deteriorates. Jensky does not disclose a resettable temperature range or a modular construction. Jensky also fails to disclose an evaporator pre-cool cycle to avoid passing hot air into the compartment upon initiating of the post-defrost cooling cycles.

While not reflected in a patent document, it is known in the art to provide removable refrigeration units for vending machines. The evaporator, compressor, and condenser of these units, are resident on a single frame which is attached to an insulated refrigeration compartment. The refrigeration unit is completely removable for quick servicing. This is advantageous in refrigeration of vending machines specifically, where quick service is desirable. The controller for the removable refrigeration unit in the prior art is found on the main circuit board on the vending machine itself which operates the other functions for the vending machine.

While advantageous in many regards, the location and function of the removable refrigeration unit controller in this prior art is not ideal. Vending machines are usually placed in particularly hostile operating environments. Location of the controller on the main circuit board exposes the controller to potential damage through abuse of the vending machine controls by patrons, as well as other board failures peculiar to the main circuit board. Moreover, this prior art only discloses a simple thermostat control of the internal refrigeration compartment temperature. This is undesirable because periodic defrosting of the evaporator is required to maintain efficient operation, reduce energy consumption, and provide a more stable temperature and easily-controllable temperature range.

SUMMARY OF THE INVENTION

The present invention overcomes many of the disadvantages found in the prior art by providing a controller located on a modular refrigeration unit for vending machines.

The invention specifically provides a refrigeration controller which thermostatically controls the refrigerated compartment temperature. The invention also has a heated evaporator within a certain wattage range to accelerate defrosting. On start-up, the controller first checks the compartment temperature to determine whether it is within a certain operating range. If so, the controller enters a thermostat loop constantly checking the refrigerated compartment temperature to assure that it is within a specified range. When the refrigerated compartment temperature rises above a certain preselected maximum temperature, the controller activates the compressor and a blower to circulate air over the evaporator to reduce the temperature of the compartment. When the compartment temperature cools to a certain preselected minimum temperature, the controller turns off the compressor. This loop continues for a certain period of time or until a defrost command is generated by the remote main circuit board.

At this point, the controller enters a defrost loop. Within the defrost loop the controller first turns the compressor and evaporator blower off and then turns the evaporator heaters on. While the heaters are on, the controller monitors both the compartment temperature and the evaporator surface temperature for a specified time. If the evaporator temperature reaches a specified maximum temperature, it is assumed by the controller that defrosting is complete, then the heater is turned off. Similarly, if the food compartment temperature rises above a certain maximum, the heater is deactivated. Even if defrosting is incomplete, the controller interrupts the defrost cycle if the compartment temperature varies outside a pre-determined range. This is advantageous because it stabilizes compartment temperature during defrosting. Finally, if the defrost time expires or an end defrost command is generated by the remote main circuit board, the heater is deactivated.

On deactivation of the heater, the controller immediately enters an evaporator pre-cool loop. This consists of activating the compressor, thereby cooling the evaporator, but not activating the blower which blows air over the evaporator into the refrigerated compartment, and simultaneously monitoring the surface temperature of the evaporator. Once the controller senses that the surface temperature of the evaporator is below the maximum-allowed compartment temperature, then the blower is activated, thereby circulating cool air over the evaporator and into the compartment. This stabilizes the compartment temperature after defrosting by reducing the evaporator temperature to a desirable level before circulating air over the evaporator. Precooling the evaporator also provides energy savings by not unnecessarily heating the contents of the compartment. At the end of a pre-cool loop, the thermostat and defrost loops repeat.

The invention also provides for the controller being physically separated from the main circuit board and mounted on a removable modular refrigeration unit. Placing the controller on the refrigeration unit itself isolates it from the main circuit board which operates all other vending machine functions. Isolation of the control unit reduces the exposure of the controller to abuse by patrons, and from main circuit board failures. The result is a more reliable vending machine in that, in the event of a main circuit failure, the controller for the refrigeration unit survives, thereby maintaining quality of the food stored in the vending machine.

The invention provides flexibility in that pre-programmed temperature range settings can be modified by the remote main circuit board to respond to changing ambient conditions or other parameters such as programmed maintenance. Additionally, dip switch settings provided on the controller itself can be changed before the unit is installed. This facilitates use of the controller in modular units such as this one, by allowing the unit to be reset to be used in various machines with different temperature range requirements.

The invention also includes a vending machine whose compartment volume, refrigeration capacity, and heater capacity are sized in such a way to achieve satisfactory defrosting under a wide range of ambient conditions.

Other advantages for the invention will become apparent to those skilled in the art after reviewing the specification, drawings and claims.

DETAILED DESCRIPTION OF THE INVENTION

Figure 1:
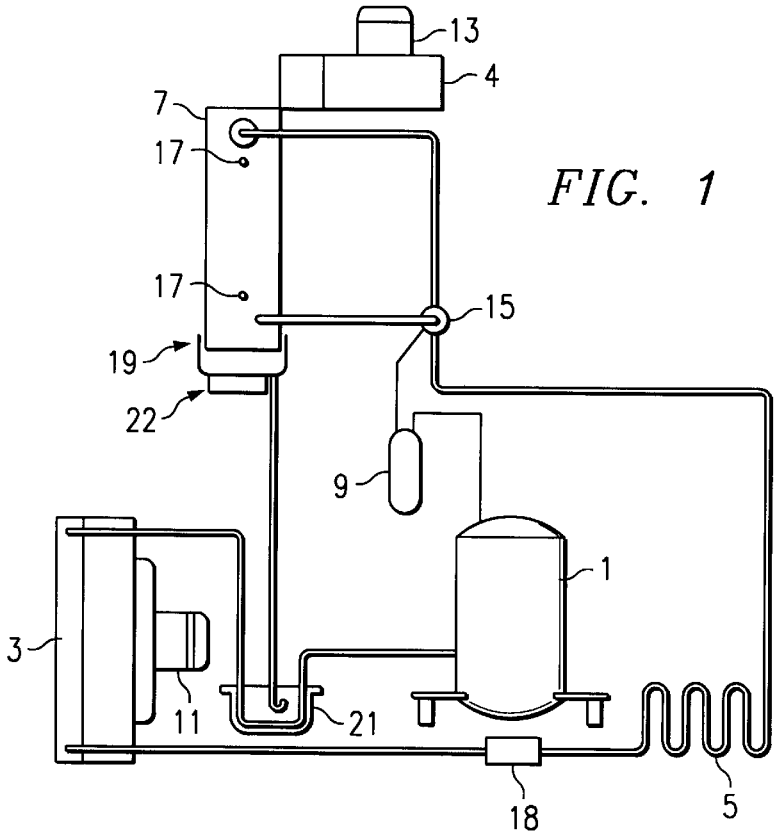
FIG. 1 is a schematic representation of the components of the modular refrigeration unit.

A schematic arrangement of the mechanical elements of the invention can be seen in FIG. 1. Compressor 1 is connected in series with condenser 3, capillary tubes 5, dryer filter 18, evaporator 7 and suction line accumulator 9. A refrigerant contained in the system is circulated as a working fluid. In operation, the compressor, operated by an electric motor, compresses refrigerant vapor and discharges it into condenser 3. The vapor is cooled and liquified by cooling air flowing over the condenser, supplied by condenser fan 11. On emergence from condenser 3, the refrigerant passes through dryer filter 18, a set of capillary tubes 5, and heat exchanger 15, where it is further cooled and liquified. The refrigerant then enters evaporator 7, absorbing heat as it does so and lowering the temperature of the air flowing over the evaporator coils. Air flow over the evaporator is supplied by evaporator blower 13. After absorbing heat from the food compartment in evaporator 7, the refrigerant, now low-pressure vapor, proceeds through heat exchanger 15, suction line accumulator 9, and back to compressor 1 to begin the cycle again. In the preferred embodiment, the refrigeration capacity of unit 30 is approximately 4500 BTUs per hour at 25° F. evaporator temperature and 130° F. condensing temperature. The preferred refrigerant is Freon R134a.

After a period of time, condensation freezes as ice on the evaporator coils, reducing air flow and efficiency of the evaporator. The preferred embodiment provides electric heater cartridges 17 resident within and integral to evaporator 7. Electric heater cartridges 17, are conventional cartridge type heaters mounted in contact with fins on the evaporator to heat the evaporator coils and fins. In the preferred embodiment, the total power of the cartridge heaters is approximately 400 watts apiece, with 2 heaters being present. Evaporator 7 is also fitted with drip pan 19 to collect runoff water when the ice is defrosted from the evaporator. Drip pan 19 is heated by heater 22 and connected to evaporation tray 21 (seen in FIG. 3A). Evaporation tray 21 is heated by the hot, high-pressure fluid line connecting compressor 1 and condenser 3. In the preferred embodiment, heater 22 has a power of approximately 50 watts. Water from the melted ice on the evaporator flows into the drip pan and the evaporation tray where it is heated and evaporated.

Figure 2:
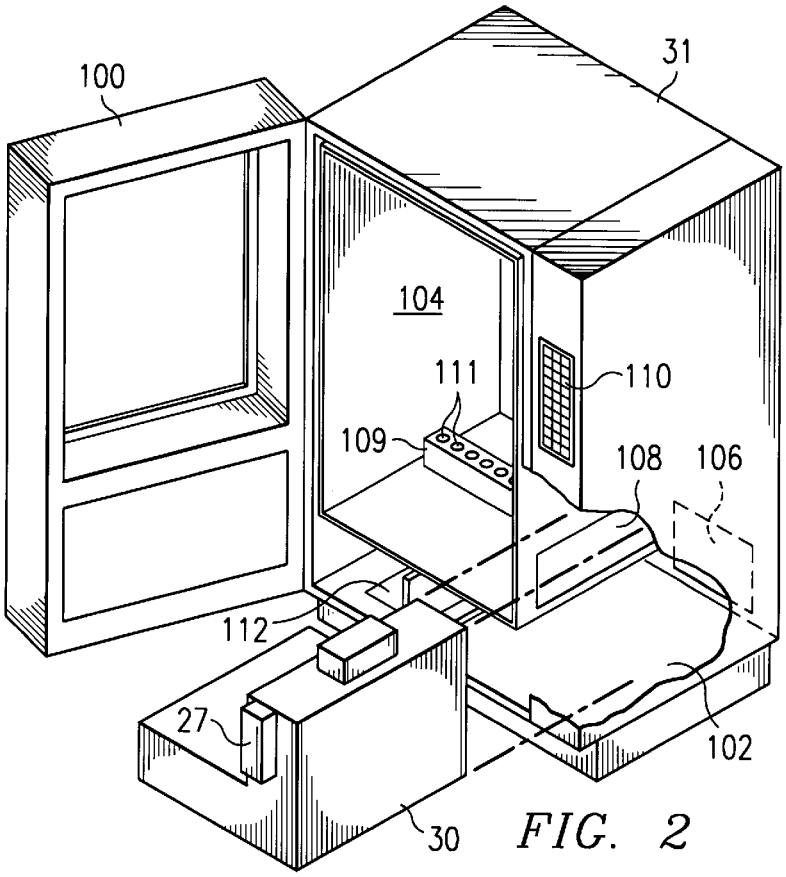
FIG. 2 is a isometric schematic exploded view of the vending machine and the modular refrigeration unit.

FIG. 2 shows an exploded view of modular refrigeration unit 30 and vending unit 31 into which it fits. Modular unit 30 includes the components of FIG. 1 and is shown in more detail in FIG. 3A. Vending unit 31 is constructed so that front door 100 swings open to reveal cavity 102 and cavity 104. Cavity 102 houses refrigeration unit 30. Cavity 104 is the refrigerated compartment in which the products to be vended are located. In the preferred embodiment, the volume capacity of cavity 104 is approximately 18 $ft.^3$. Modular refrigeration unit 30 slides into cavity 102 from the front of vending unit 31. A switch panel 110 is mounted in the face of vending unit 31. A conventional main circuit board ("main circuit board") (not shown) is mounted behind control panel 110 on an interior wall of vending unit 31. The main circuit board controls the dispensing functions of the vending unit 31.

Figure 4:
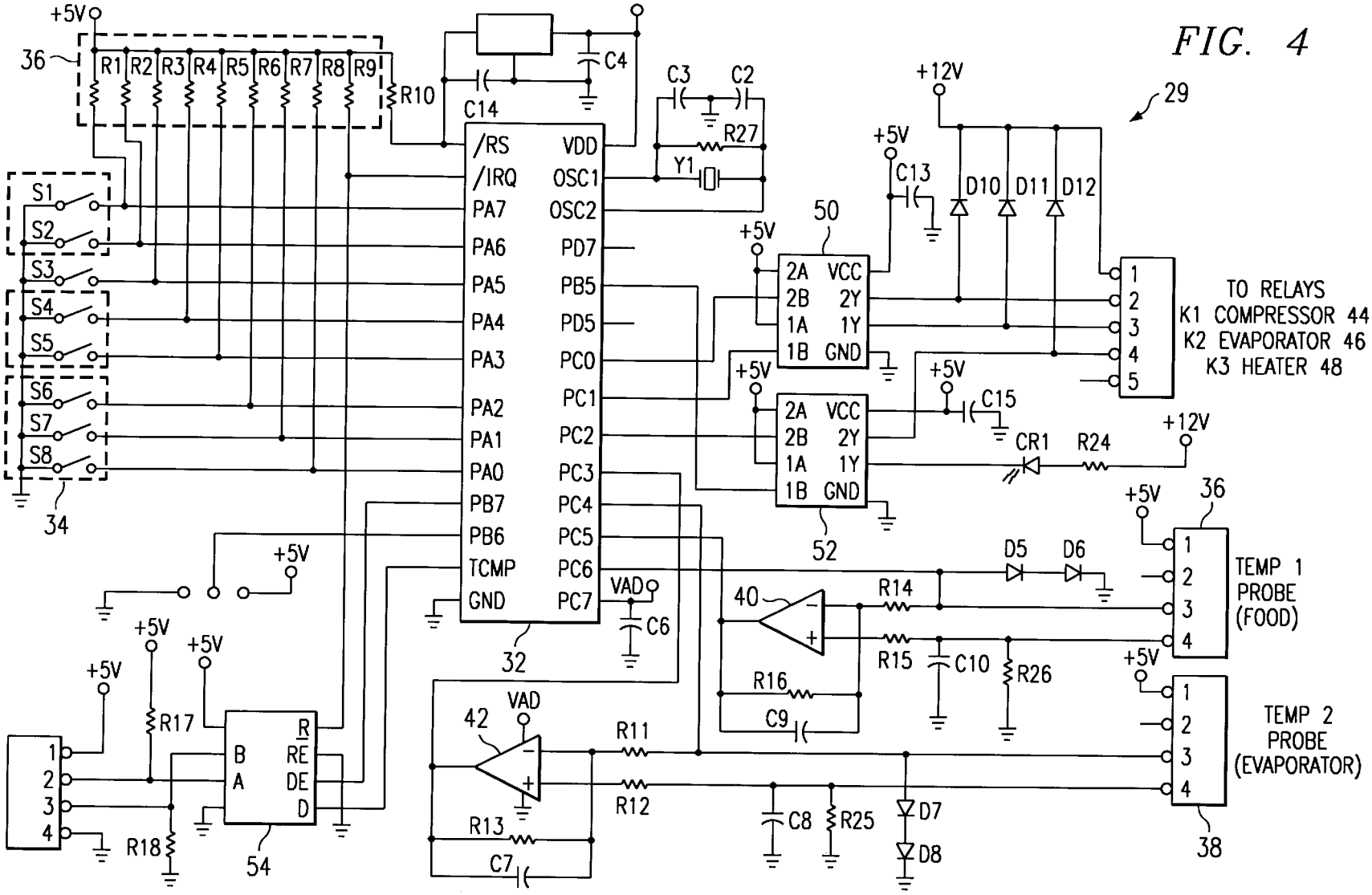
FIG. 4 is a schematic diagram of the control circuit of the modular refrigeration unit.

Isolated box 27 is mounted on the side of modular refrigeration unit 30 and contains controller board 36 and relays 44, 46, and 48 which are indicated on FIG. 4. Isolated box 27 is situated so that when refrigeration unit 30 is placed into vending unit 31 it is shielded from the low temperatures maintained in cavity 104. This is to protect controller 36 from unnecessary temperature variations and humidity. When modular unit 30 is mounted in vending unit 31, controller 36 is electrically connected to the main circuit board and reports the status and temperature of various elements of the modular unit, as will be further described later. A power supply for the controller 36 is mounted on modular unit 30, inside isolated box 27, as well. For this reason, if switch panel 110 or the main circuit board fails, controller 36 can function independently, thereby maintaining temperature control of cavity 104, and its contents.

Figure 3B:
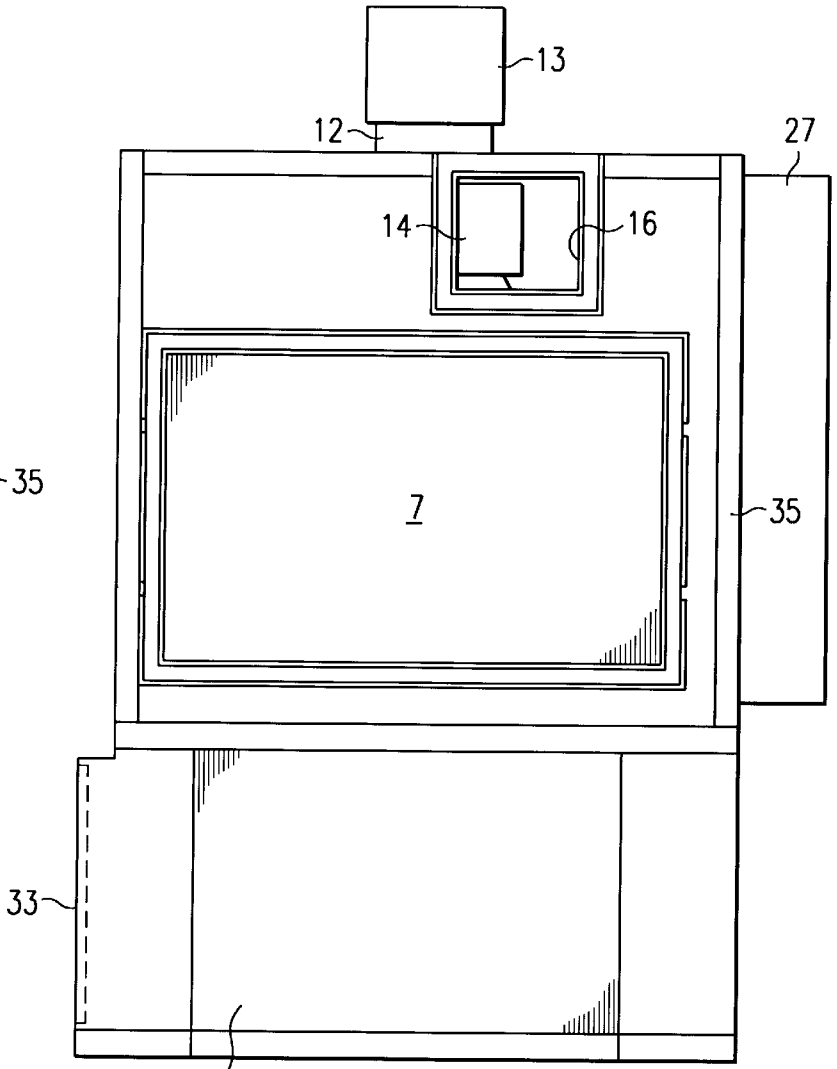
FIG. 3B is a front view of the modular refrigeration unit.

Modular refrigeration unit 30 will now be described in more detail referring to FIGS. 3A and 3B. Compressor 1, condenser 3, and condenser fan 11 are situated in a bottom box 29. Evaporation tray 21 is also located in box 29. When compressor 1 and condenser fan 11 are activated, cooling air is forced from left to right by condenser fan 11. The cooling air is drawn into the bottom of the vending unit 31 through air intake duct 112. The cooling air for condenser 3 is exhausted through duct 33 on the back side of the unit and exits through duct 106 in the back of vending unit 31. Condenser 3 and compressor 1 are connected by high pressure tubing which will not be described because it is well known in the art.

Figure 3A:
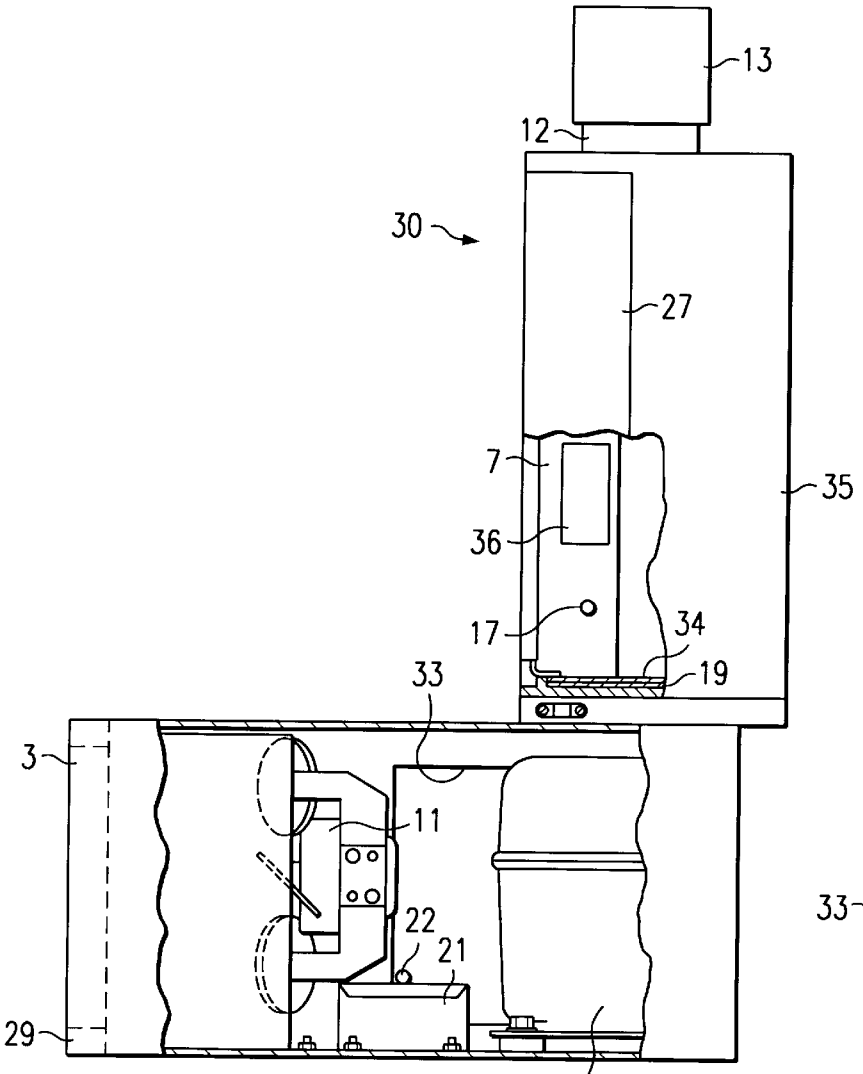
FIG. 3A is a side view of the modular refrigeration unit.

In FIG. 3A, evaporator 7 is positioned vertically in insulated box 35 which is mounted on bottom box 29. A cut-away view of the insulation is shown at 34. This insulation surrounds the interior of insulated box 35. As seen in FIG. 3B, the evaporator blower 13 includes an electric motor 12 and an impeller 14. In operation, door 100 is closed and latched, forming a closed compartment including cavity 104. Air is drawn from cavity 104 through intake duct 108 adjacent cavity 104 and passed over evaporator 7 of refrigeration unit 30 by the impeller 14. The cooler air is then expelled, returning via exhaust duct 109 into cavity 104. Duct 109 is constructed to redistribute the cool air within cavity 104 via holes 111.

As will be described more fully below, defrosting of evaporator 7 must be completed within a specified defrost time; usually in the preferred embodiment, about three to four minutes. The heaters 17 are sized so that efficient and complete defrosting can occur within this time. The power of the heaters, and refrigeration capacity of the refrigeration unit has been selected so as to ensure that complete defrosting of the evaporator occurs, given the volume of compartment 104 and specified defrosting time.

Referring now to FIG. 4, circuit 28 consists of a microprocessor 32 having input/output ports PA0, PA1, PA2, PA3, PA4, PA5, PA6, PA7, PB5, PB6, PC0, PC1, and PC2, serial input/output port PB7, analog-to-digital ports PC3, PC4, PC5, PC6, and PC7, and a timer compare output, TCMP, and interrupt request port /IRQ, for communication of certain data parameters which will be further described. Switch network 34, including switches S1 through S8, which are connected to ground, and to inputs PA7 through PA0 through a series of current limiting resistors 39, R1 through R9.

Switches S1 and S2 generate various high and low signals, depending on their positions which are read by the microprocessor 32 on power-up and interpreted to define communication parameters of the circuit. S1 and S2 form a 2-bit input; a 00 input enables the communication capabilities of the circuit to the main circuit board, and allows for expandability to future embodiments; a 01 input is undefined; a 10 input indicates a stand-alone mode in which the controller 36 controls refrigeration functions of the unit and enables only an active/inactive status and temperature output to the main circuit board; a 11 input indicates a similar stand-alone feature, but enables a diagnostic display to report various temperatures. Switch S3 forms a 1-bit input indicating to the microprocessor whether there are one or two temperature probes connected to controller 36, one for refrigeration compartment temperature and one for the evaporator surface temperature.

The operating temperature range for the preferred embodiment of the invention requires setting two parameters: the first parameter determines a base temperature setting; the second parameter determines a positive or negative deviation from the base temperature setting. The midpoint temperature between the base temperature plus the deviation temperature is taken as the center operating temperature. During normal operation, the microprocessor will maintain the refrigerated compartment at the center temperature plus or minus 2° F., as will be further described later.

Switches S4 and S5 form a 2-bit input determining the base operating temperature of the refrigeration compartment; a 00 input sets a base operating temperature of about 60° F.; a 01 input determines a base operating temperature of about 36° F.; a 01 input determines a base operating temperature of about 20° F.; and a 11 input indicates a −05° F. base operating temperature. Switches S6, S7, and S8 form a 3-bit input indicating the temperature deviation; a 000 input indicates 0° F. deviation; a 001 indicates a +2° F. deviation; a 010 input indicates a +4° F. deviation; a 011 input indicates a +6° F. deviation; a 100 indicates a −2° F. temperature deviation; a 010 input indicates a −4° F. deviation; a 110° input indicates a −6° F. deviation; and a 111 input indicates a −8° F. deviation. The input switch settings are read on start-up of the unit and, consequently, power-up of the microprocessor.

The preferred embodiment uses the memory of microprocessor 32 to store various required parameters for comparison. Additionally, microprocessor 32 is used to compare certain input temperature values against stored memory values and to activate the heaters 17, evaporator blower 13, compressor 1, and compressor fan 11.

The circuit 28 employs two temperature probes 37 and 41. Temperature probe 37 is located in the refrigerated compartment 104; temperature probe 41 is located on the surface of the evaporator 7. Both temperature probes are connected to CMOS dual operational amplifiers 40 and 42, respectively, capable of holding the tolerance of the temperatures sensed by the probes to +1° F. The output of the amplifiers 40 and 42 are fed directly to the analog-to-digital converter of the microprocessor 32 at terminals PC5 and PC3, respectively. The unamplified negative terminal of each probe is fed to the analog-to-digital converter of microprocessor 32 at terminals PC6 and PC4, respectively. The negative terminal voltage of the probes is used as a basis for comparison to the output amplified voltage provided by amplifiers 40 and 42. The compressor, evaporator, and heater relays 44, 46, and 48, respectively, are connected directly to a pair of dual peripheral drivers 50 and 52 capable of high current switching at high speed. The drivers are, in turn, connected to the input/output ports of the microprocessor at terminals PC0, PC1 and PC2, respectively. Upon receipt of the appropriate low signal from the microprocessor 32, drivers 50 and 52 activate the compressor, evaporator, or heater by switching relays 44, 46, or 48.

Output PB5 of microprocessor 32 is used to drive output LED 55 via driver 52. Terminal PB6 is designated as an input port. It is used to set the communication address of the driver 54. When connected to +5V, the microprocessor 32 sets the address of driver 54 to a first address; when connected to ground, a second, different address is set. Different addresses allow two controllers to communicate with the same main circuit board. For example, two complete refrigeration units may be installed in a single, large vending machine, controlled by one main circuit board, thus doubling the available cooling capacity.

Finally, the serial I/O ports PB7 and TCMP are both connected to multi-point transceiver communication buffer line driver 54 in order to drive communication lines to communicate with the main circuit board (not shown). Line driver 54 is also connected to the interrupt request port /IRQ of microprocessor 32. This line is held high via connection to +5V through current limiting resistor R10. When pulled low by line driver 54, microprocessor 32 responds by recognizing the signals present at the interrupt request port /IRQ and builds command messages by sampling the /IRQ port at predetermined intervals. In the preferred embodiment, these intervals are 8 bits apiece. These signals are used to reset the values for the base temperature operating range, deviation and maximum evaporator temperature values initially set by switches S0–S7 and, additionally, may command the microprocessor to turn on and turn off the compressor, evaporator, or heater relays independently, thus overriding the normal operating mode. Additionally, the defrost time value and heater time value may be reset by the main circuit board this way. I/O port PB7 is used to change the direction of the line driver 54 and allow the microprocessor to send signals to the main circuit board. These signals reflect the current status of the relays, current base temperature settings and current temperature at both temperature probes. Other aspects of the circuit, such as current and voltage filtering and stabilization, timers and power supply are well known in the art and will not be detailed here.

While various components may be substituted for those disclosed, the following components, shown in Table I, are employed in the circuit shown in FIG. 4 in the preferred embodiment:

TABLE I

| Item | Quantity | Reference | Part Number | Description |
|---|---|---|---|---|
| 1 | 1 | CR1 | MV-6753 | LED-RED |
| 2 | 1 | C1 | 470 μF | Capacitor |
| 3 | 2 | C3, C2 | 37pF | Capacitor |
| 4 | 5 | C4, C6, C13, C14, C15 | .1 μF | Capacitor |
| 5 | 4 | C7, C8, C9, C10 | .01 μF | Capacitor |
| 6 | 1 | C11 | 220 μF 25V | Capacitor |
| 7 | 4 | D5, D6, D7, D8 | 1N4148 | Diode |
| 8 | 3 | D10, D11, D12 | 1N4004 | Diode |
| 9 | 16 | R1, R2, R3, R4, R5, R6, R7, R8, R9, R10, R11, R12, R14, R15, R17, R18 | 10K | Resistor |
| 10 | 2 | R13, R16 | 40K | Resistor |
| 11 | 1 | R24 | 330 ohm | Resistor |
| 12 | 2 | R25, R26 | 18K | Resistor |
| 13 | 1 | R27 | 4.7M | Resistor |
| 14 | 1 | R28 | 1.2K | Resistor |
| 15 | 1 | S1 | SW1 | Dip Switch - 8 position |
| 16 | 1 | U1 | MC68HC05P9 | Micro-processor |

TABLE I-continued

| Item | Quantity | Reference | Part Number | Description |
|---|---|---|---|---|
| 17 | 1 | U2 | MC34064-5 | Under-voltage sensor |
| 18 | 1 | U3 | LMC662 | Dual Op-amp |
| 19 | 2 | U6, U4 | SN 75154 | Relay Driver |
| 20 | 1 | U8 | SN 75176 | RS-485 Driver |
| 21 | 1 | Y1 | 4 MHz | Crystal |

Under-voltage sensor, item 17, part number MC34064-5 is a sensing circuit specifically designed to use as a reset controller in microprocessor-based systems. It is available from Motorola, and its technical specifications are well known. Item 18, part number LMC662, is a CMOS dual operational amplifier, available from National Semiconductor. Its specifications are well known. Item 19, part number SN 75451, is a dual peripheral positive-AND driver available from Texas Instruments. Its specifications and characteristics are well known. Item 20, part SN 75176, is a multi-point transceiver, available from National Semiconductor. The component is a high-speed differential tri-state bus line transceiver for multi-point data transmission. Its capabilities and specifications are also well known.

Other microprocessors can be employed to accomplish the goals of the invention, but the preferred embodiment uses a Motorola medium capability MC68HC05P9 microprocessor. This particular microprocessor has 2112 bytes of user ROM, and 128 bytes of user SRAM memory. This microprocessor also has the capability of receiving input data into memory via an analog-to-digital converter, or serial input/output port, as well as other features which make the chip particularly suitable for the preferred embodiment of the invention.

Figure 5:
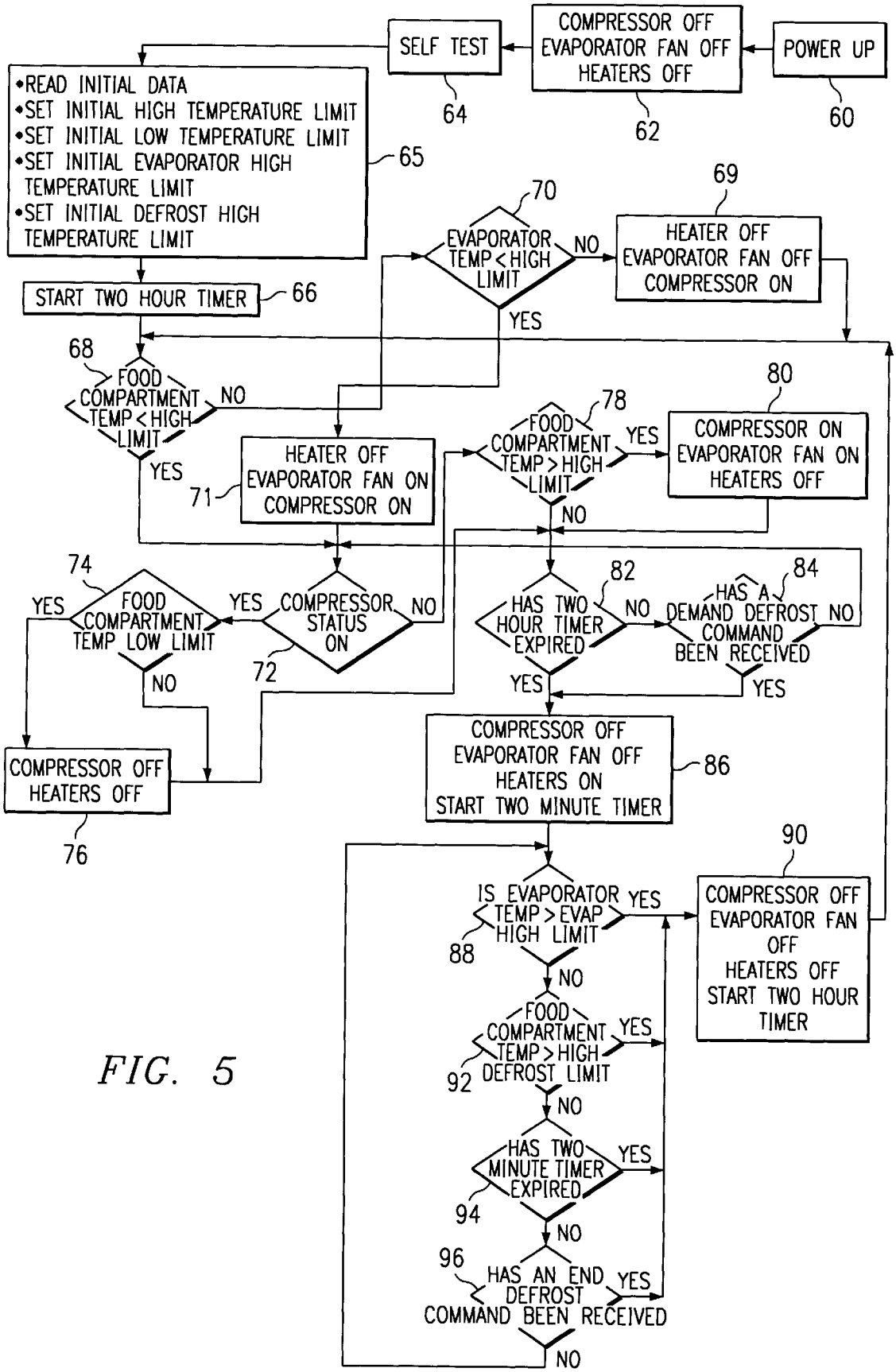
FIG. 5 comprises a flow chart of the control program of the controller.

A flow chart showing the steps carried out by microprocessor 32 during operation of refrigeration unit 30 is shown in FIG. 5. The detailed steps of the flow chart program are stored in the user ROM section of microprocessor 32 and are implemented upon power-up of the unit.

On initial power-up, block 60, microprocessor 32 is activated, immediately moving to block 62 and initializing compressor 1, evaporator blower 13 and heaters 17 to an "off" state. At block 64, the microprocessor runs a self-check contained in ROM memory on-board. Assuming that the self-test is completed successfully, the microprocessor reads the status of Switches SW0–SW7 to determine operating mode, number of temperature probes and center temperature set point. At block 65, the temperature high limit is set to the center temperature +2° F. The temperature low limit is set to the center temperature −2° F., the initial evaporator high temperature limit is set to 66° F. and the initial defrost high temperature limit is set to the center temperature +4° F. The microprocessor then starts a two-hour timer at block 66.

Following the initiation of the two-hour timer, microprocessor 32 polls temperature probe 37 in refrigeration compartment 104 at block 68. If the temperature sensed is less than high limit, the running condition of compressor 1 is then checked. This condition might occur upon a short power outage where the compartment 104 would not warm up significantly. If the temperature in the compartment is not less than high limit, microprocessor 32 then polls evaporator temperature probe 41 at block 70. If it is less than high limit, then the heaters 17 are checked to make sure they are off, evaporator blower 13 is activated, and compressor 1 is activated. If the evaporator temperature is not less than high limit and the food compartment temperature is not less than high limit, microprocessor 32 enters a "pre-cool" cycle in which heaters 17 are turned off, the evaporator blower 13 is turned off, and the compressor 1 is turned on at block 69. The "pre-cool" cycle lowers the evaporator temperature, before activating the blower 13, to prevent blowing hot air into the compartment or circulating hot air that is already present. Microprocessor 32 stays in this "pre-cool" loop until the evaporator temperature sensed is less than high limit at block 70. Upon reaching an evaporator temperature of less than high limit, evaporator blower 13 is turned on to circulate cool air in the refrigerated compartment at block 71. As soon as the evaporator blower 13 is on and the compressor 1 is on, the microprocessor 32 moves to block 72.

Block 72 begins the normal refrigeration cycle for the unit. During the refrigeration cycle, the temperature is monitored within the compartment to assure that the food contained does not freeze or spoil, depending on the base operating temperature set by switch block 34 or instructions from the main circuit board. As will be discussed more fully below, the main circuit board can override the initial settings of switch block 34, defrost cycle times, heater times, and initiate or terminate a defrosting cycle via communication port IRQ (shown in FIG. 4). The override signals provided by the main circuit board are not necessary for the functioning of the invention, but add the advantage of expandability by allowing additional parameters to control the defrost functions of the unit.

At block 72 the running status of compressor 1 is polled to determine whether it is "on" or "off." If compressor 1 is "on," food temperature probe 37 is checked at block 74 to determine if the temperature is below low limit. If the temperature is below low limit, then microprocessor 32 switches off compressor 1 at block 76. If the food temperature in compartment 104 is not less than low limit, the evaporator blower 13 and compressor 1 are left running. If compressor 1 is determined not to be "on" at block 72, microprocessor 32 polls temperature sensor 37 in the refrigerated compartment to determine if it is above high limit, at block 78. If it is determined that compressor 1 is not "on" and that refrigerated compartment 104 is above high limit at block 80, then microprocessor 32 activates compressor 1 and the evaporator blower 13, and assures that the heaters 17 are deactivated.

Upon determining a negative response to blocks 74 or 78, or upon completion of the activities in block 76 or 80, microprocessor 32 checks to see if the two-hour timer, started at block 66, has expired at block 82. Upon determining that the two-hour timer has not expired, communications buffer 54 is checked at block 84 to determine if the main circuit board has transmitted a command instructing microprocessor 32 to begin the defrost cycle. The main circuit board controls the vending functions of vending unit 31. It may be provided with an emergency defrost button which could transmit a command to microprocessor 32 to initiate defrosting. Additionally, other conditions, such as the number of items present in compartment 104, may affect the amount of defrosting required, necessitating transmission of a defrost override signal. If no such command has been received, the microprocessor 32 returns to block 72 to continue the normal refrigeration loop comprising blocks 72–84. If a defrost command was received, microprocessor 32 proceeds to beginning of the defrost cycle at block 86. The defrost cycle at block 86 is also reached if it is determined at block 82 that the two-hour timer has expired during the normal refrigeration loop.

Upon initiation of the defrost cycle at block 86, compressor 1 is turned off, evaporator blower 13 is turned off, heaters 17 are turned on, and a two-minute defrost timer is initiated. After block 86, the microprocessor moves to block 88 where the evaporator temperature is polled. If it is determined that the evaporator temperature is greater than the evaporator high temperature limit, microprocessor 32 assumes that defrosting is complete and moves to block 90 to avoid unnecessary heating of the evaporator and the refrigerated compartment. Resetting this temperature might become necessary to compensate for ambient conditions, such as high humidity, which would necessitate more intensive defrosting. The main circuit board could be fitted with switches to change this setting during routine service, for instance. The evaporator high temperature limit is normally 66° F., but can be reset by the main circuit board.

At block 90 heaters 17 are turned off, compressor 1 is turned off, evaporator blower 13 is turned off, the two-hour timer is started, and the process continues at block 68. If, however, the evaporator temperature is determined to be less than the evaporator high temperature limit, microprocessor 32 moves to block 92, where it polls the refrigeration compartment temperature. At block 92, if it is determined that the refrigeration compartment temperature is above the initial defrost high temperature limit, microprocessor 32 aborts the defrost cycle and moves immediately to block 90. The initial defrost high temperature limit is set to the high limit +4° F., but can be reset by the main circuit board.

If it is determined that the food compartment temperature is still less than high limit, microprocessor moves to block 94. In block 94, microprocessor 32 checks to determine if the two-minute defrost timer has expired. If it has, microprocessor 32 proceeds to block 90. If the two-minute timer has not expired, microprocessor 32 polls the communications buffer 54 to determine if a command to end the defrost cycle has been received from the main circuit board at block 96. The main circuit board may be fitted to sense additional ambient conditions which can further reduce or increase the required defrost time. For example, if the compartment 104 is fully stocked with items to be vended, the defrost cycle time required may be longer than two minutes. If an end defrost command is received, the microprocessor moves to step 90, effectively skipping the defrost cycle. Upon receipt of the end defrost command, the defrost cycle is skipped only once; microprocessor 32 returns to the refrigeration loop and initiates the defrost cycle again after the expiration of 2 hours. If a defrost command signal is not received, the microprocessor returns to block 88 to continue the defrost cycle until one of the canceling conditions in blocks 88, 92, 94, or 96 arises.

At step 90, the microprocessor has determined that the defrost cycle must be completed. After step 90, the microprocessor returns to block 68 where the two-hour timer is reset and the refrigeration loop is started again.

It should be understood that modifications to the preferred embodiment will be obvious to those who are skilled in the art upon examining the specification, drawings and claims. The invention has been described with the regard to the preferred embodiment, but should only be limited by the scope of the appended claims and equivalents.

It is claimed:

1. A control system for a refrigerator having a refrigerated compartment, a compressor, an evaporator, and an evaporator heater, the control system comprising:

A. a compartment temperature sensor within the refrigerated compartment;

B. an evaporator temperature sensor on the evaporator;

C. a controller, electrically coupled to the compartment temperature sensor, wherein the controller produces a compressor activation signal which activates the compressor in response to the temperature of the compartment temperature sensor rising above a certain specified range and a compressor deactivation signal which deactivates the compressor in response to the temperature of the compartment temperature sensor falling below the certain specified temperature range;

D. a timing means for generating a defrost cycle time signal;

E. a timing means for generating a maximum heating time signal;

F. the controller, responsive to the defrost cycle time signal, producing a start defrost control signal which activates the heater and deactivates the compressor; and G. the controller, electrically coupled to the evaporator temperature sensor, producing a stop defrost control signal which deactivates the heater and activates the compressor in response to the temperature of the evaporator temperature sensor rising above a specified evaporator temperature, the compartment temperature sensor rising above a specified compartment temperature or in response to the maximum heating time signal.

2. The control system of claim 1 wherein the controller further comprises means for selecting from a plurality of specified temperature ranges.

3. The control system of claim 1 wherein the specified defrost cycle time signal is generated once about every 2 hours.

4. The control system of claim 1 wherein the maximum heating time signal is generated for about 2 minutes.

5. The control system of claim 1 wherein the controller is a microprocessor.

6. The control system of claim 1 wherein the control system further comprises means for expanding or contracting the specified temperature range.

7. The control system of claim 1 wherein the specified range is between about 36° F. and 40° F.

8. The control system of claim 1 wherein the specified evaporator temperature is about 66° F.

9. The control system of claim 1 wherein the refrigerator includes an evaporator fan, the control system further comprising the controller, electrically coupled to the evaporator fan, responsive to the temperature of evaporator temperature sensor falling within the specified range, generating a pre-cool complete control signal; the pre-cool complete control signal activating the evaporator fan.

10. The control system of claim 1 wherein the controller further comprises means for receiving a stop defrost override signal from a second controller and responsive to the stop defrost override signal generating the stop defrost control signal thereby deactivating the heater and activating the compressor.

11. The control system of claim 1 wherein the controller further comprises means for receiving a start defrost override signal from a second controller and responsive to the start defrost override signal generating the start defrost control signal thereby activating the heater and deactivating the compressor.

12. A modular control system for a vending machine having a refrigerated compartment, a compressor, an evaporator, and an evaporator heater, the modular control system, comprising:

A. a compartment temperature sensor within the refrigerated compartment:

B. an evaporator temperature sensor on the evaporator;

C. a controller, electrically coupled to the compartment temperature sensor. wherein the controller produces a compressor activation signal which activates the compressor in response to the temperature of the compartment temperature sensor rising above a certain specified range and a compressor deactivation signal which deactivates the compressor in response to the temperature of the compartment temperature sensor falling below the certain specified temperature range, D. a timing means for generating a defrost cycle time signal;

E. a timing means for generating a maximum heating time signal:

F. the controller, responsive to the defrost cycle time signal, producing a start defrost control signal which activates the heater and deactivates the compressor:

G. the controller, electrically coupled to the evaporator temperature sensor, producing a stop defrost control signal which deactivates the heater and activates the compressor in response to the temperature of the evaporator temperature sensor rising above a specified evaporator temperature, or in response to the maximum heating time signal;

wherein the controller includes a communication means for communicating the certain specified temperature range, the temperature of the evaporator temperature sensor and the temperature of the compartment temperature sensor to a second controller on the vending machine, wherein said second controller can display said certain specified temperature range, and the temperatures of the evaporator temperature sensor and compartment temperature sensor by communicating with the controller through said communication means.

13. The modular control system of claim 12 wherein said vending machine includes a second modular control system and wherein the communication means includes a changeable address whereby said second controller can reset or operate one or both of said modular control systems.

14. The modular control system of claim 12 wherein said second controller can reset said certain specified temperature range, and the temperatures of the evaporator temperature sensor and compartment temperature sensor by communicating with the controller through said communication means.

15. A method of controlling and defrosting a refrigerated product dispenser cabinet, including a compressor and an evaporator heater, comprising the steps of:

A. receiving and storing a maximum cabinet temperature value, a minimum cabinet temperature value, a defrost cycle time value, a heated defrost time-out value and a maximum evaporator temperature value;

B. sensing the temperature within the cabinet and the temperature of the evaporator;

C. cyclically monitoring the cabinet temperature and activating the compressor when the cabinet temperature is above the maximum cabinet temperature value and deactivating the compressor when the cabinet temperature is below the minimum cabinet temperature;

D. advancing and monitoring a system timer;

E. activating the heater when the defrost cycle time value is reached by the timer and deactivating the heater when the heated defrost time-out value is reached by the timer or the cabinet temperature has reached the maximum cabinet temperature value, and F. activating the compressor.

16. The method of claim 15 further comprising the step of cyclically monitoring the evaporator temperature after deactivation of the heater and actuating the compressor if the evaporator temperature is above the maximum evaporator temperature value.

17. The method of claim 15 wherein the refrigerated product dispenser cabinet includes an evaporator fan; the method further comprising the step of activating the evaporator fan when the evaporator temperature is below the maximum cabinet temperature value.

18. The method of claim 15 further comprising the step of receiving an end defrost command signal from a second controller and deactivating the heater.

19. The method of claim 15 further comprising the step of receiving a demand defrost signal from a second controller and activating the heater.

20. The method of claim 15 further comprising the step of receiving and storing a second maximum cabinet temperature value, a second minimum cabinet temperature value, a second defrost cycle time value, a second heated defrost time-out value, and a second maximum evaporator temperature value which can be selected by a second controller to change the operating characteristics of a refrigerated product dispenser cabinet.

* * * * *